US007524600B2

(12) United States Patent
Toizumi et al.

(10) Patent No.: US 7,524,600 B2
(45) Date of Patent: Apr. 28, 2009

(54) ELECTROPHOTOGRAPHIC TONER

(75) Inventors: Tomoko Toizumi, Nara (JP); Yoshiaki Akazawa, Nara (JP); Satoshi Ogawa, Nara (JP); Masao Suzuki, Yamatokoriyama (JP); Akio Matsumoto, Nara (JP); Hiroshi Onda, Yamatokoriyama (JP); Kiyoshi Toizumi, Nara (JP); Toshihisa Ishida, Kashiba (JP); Tadayuki Sawai, Nara (JP); Kouji Kida, Nara (JP); Tohru Nishikawa, Yamatokoriyama (JP); Masahiko Kubo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 290 days.

(21) Appl. No.: 11/348,398

(22) Filed: Feb. 7, 2006

(65) Prior Publication Data

US 2006/0177755 A1 Aug. 10, 2006

(30) Foreign Application Priority Data

Feb. 9, 2005 (JP) ..... P2005-033569
Feb. 25, 2005 (JP) ..... P2005-051247

(51) Int. Cl.
*G03G 9/097* (2006.01)

(52) U.S. Cl. ..... 430/108.3; 430/108.8; 430/109.4; 430/108.1

(58) Field of Classification Search ..... 430/108.3, 430/109.4, 108.8
See application file for complete search history.

(56) References Cited

U.S. PATENT DOCUMENTS 4,868,085 A * 9/1989 Aita ..... 430/109.4
5,558,967 A 9/1996 Nagatsuka et al.
6,150,062 A 11/2000 Sugizaki et al.
6,528,222 B2 * 3/2003 Kohtaki et al. ..... 430/108.21
7,309,558 B1 * 12/2007 Michel et al. ..... 430/108.21

FOREIGN PATENT DOCUMENTS

| | | | | |
|---|---|---|---|---|
| CN | 1220416 | A | | 6/1999 |
| CN | 1399733 | A | | 2/2003 |
| CN | 1497364 | A | | 5/2004 |
| EP | 1 403 723 | A2 | | 3/2004 |
| JP | 5-197203 | | | 8/1993 |
| JP | 2000-267355 | | | 9/2000 |
| JP | 2003-029448 | | | 1/2003 |
| JP | 2003029448 | A | * | 1/2003 |
| JP | 2003-122046 | | | 4/2003 |
| JP | 2003202708 | A | * | 7/2003 |
| JP | 2004-004207 | | | 1/2004 |
| JP | 2004-012581 | | | 1/2004 |
| JP | 2004004207 | A | * | 1/2004 |
| JP | 2004-246123 | | | 9/2004 |

OTHER PUBLICATIONS

JPO English translation of JP 2003029448 (Jan. 2003).*
JPO English translation of JP 2003202708 (Jul. 2003).*
JPO English transtion of JP 2004004207 (Jan. 2004).*
HDD using BENTONIL, 9 pages, no date.*
AIPN translation of JP 2003-029448 (2003).*

* cited by examiner

*Primary Examiner*—Christopher RoDee
(74) *Attorney, Agent, or Firm*—Nixon & Vanderhye P.C.

(57) ABSTRACT

Provided is a toner not undergoing the effect of change of temperature and humidity, with high charging stability and having good fixing property and releasability. This is an electrophotographic toner containing at least a binder resin, a colorant, a charge controller and a wax in which the binder resin comprises a polyester resin having an aromatic alcohol ingredient, the charge controller comprises an organic bentonite and the wax comprises a non-polar paraffin wax.

12 Claims, No Drawings

ELECTROPHOTOGRAPHIC TONER

BACKGROUND OF THE INVENTION

1. Field of the Invention

The present invention relates to an electrophotographic toner. More specifically, the invention relates to an electrophotographic toner used as a developer in a so-called electrophotographic image forming apparatus such as an electrostatic copying machine or a laser beam printer.

2. Description of the Related Art

Image formation in the electrophotographic image forming apparatus is conducted in accordance with each of the steps of charging, exposure, development, transfer, and fixing. At first, in the charging step, the surface of a photoreceptor as an image support for forming static latent images is charged uniformly. In the exposing step, a light in accordance with image information is irradiated to the charged surface of the photoreceptor thereby forming static latent images on the surface thereof. In the developing step, a black toner, for example, is deposited selectively to the formed static latent images, and visible images (toner images) with the toner are formed on the surface of the photoreceptor. Then, in the transferring step, the toner images are transferred by electrostatic force on a transfer paper. In the final fixing step, the toner images transferred on the transfer paper are melted by heating to fix the toner images on the transfer paper.

Further, electrophotographic coloring techniques have been developed rapidly in recent years, and full color image forming apparatus have been developed and provided to markets. The markets for the color image forming apparatus have been extended along with popularization of black and white image forming apparatus. Generally, for reproducing colors in the full color image forming apparatus, toners of three colors of yellow (Y), magenta (M), and cyan (C) as three primary colors in subtractive color mixing, or four color with addition of black (K) to the three colors are used. As the procedure for reproducing the colors, the steps up to the charging, exposure, development and transfer are repeated among the image forming steps to each of the colors of C, M, Y and K and toner images comprising toners of a plurality of colors are superposed on the transfer paper thereby forming full color images. Then, in the final fixing step, the superposed toner images are melted and fixed on the transfer paper. In the procedures, since the superposed toner images are mixed by melting, colors are reproduced in accordance with the principle of subtractive color mixing.

In the full color electrophotography described above, since it is necessary for conducting development for a plurality of times and superposing several kinds of toner images of different colors on one identical support in the fixing step, charging characteristic and the fixing characteristic to be provided for the toners of respective colors are extremely important factors.

That is, in order to keep stable and good color reproducibility of full color images, it is at first necessary to transfer a predetermined amount of a toner on the transfer paper from the developing step in the transfer. The deposition amount of the toner in the developing and transferring steps greatly depends on the charging characteristics of the toner such as the rising characteristic of the charged amount, the circumstantial stability and the aging stability for the charged amount, the durability, etc of the toner. Therefore, a charge controller is incorporated in the toner to keep a good chargeability as a first measure. A toner using a polyester resin is usually negatively charging and, as a negatively charging controller, oil soluble dyes such as oil black and spiron black, metal-containing azo dyes, metal naphthenate salts, metal alkyl salicylate salts, fatty acid soaps, resinic acid soaps, etc. are used.

Then, various devices have been made for finely dispersing the charge controller uniformly in the toner. In addition, it is also an important factor to select the kind and the chemical composition of the binder resin for the toner. In order to make the charging characteristic of the toner excellent, it is an important factor not only using a charge controller of excellent charging characteristic but also selecting and using a resin capable of finely dispersing the charge controller uniformly in accordance with the charge controller to be used.

Each of the color toners of different colors transferred to the transfer paper is fixed in the fixing step. In this case, the fixed color toner has to be such a color toner having a wide range of color reproducibility that can be melted till the boundary between each of toner particles is eliminated to obtain transparency. Further, it requires appropriate glossiness.

As the fixing device for fixing the color toner, a heating roller utilizing a material of excellent surface releasability relative to the toner is used. However, in most of the devices, a great amount of oil is coated on the surface of the fixing roller, etc. in order to prevent offset. Accordingly, the transfer paper is contaminated with the oil, and provision of the oil supply portion and an oil coating portion is essential, which results in a problem such as increase in the size of the fixing device, complication of the mechanism and, further, increase in the cost.

Generally, the reason of using the oil for fixing the color toner is as described below. Compared with fixing under heating of a black toner for use in usual black and white printing, it is necessary to increase the fusibility to obtain a transparency and reduce the viscosity of the color toner. However, in such a color toner, cohesion during melting is lowered to cause adherence of the toner to the fixing roller to result in high temperature offset phenomenon. Accordingly, in order to prevent the high temperature offset, a great amount of oil was coated to the fixing roller thereby decreasing the adherence of the toner to be fixing roller.

In view of the above, with an aim of simplifying the fixing device and preventing undesired effects of the oil on the images (oil contamination, stickiness), it has become necessary to cope with the development of an oilless mechanism of saving a silicon oil coating mechanism. For this purpose, improvement for the fixing characteristic with the toner in a wide range from low temperature to high temperature has been desired so that the fixing roller can be used without coating the oil and provision of a so-called oilless toner for coping therewith has been attempted.

For this purpose, it has been proposed to disperse a wax in the toner. As the wax, amide wax, carnauba wax, higher fatty acids and esters thereof, higher fatty acid metal soaps, partially saponifying higher fatty acid esters, higher aliphatic alcohols, polyolefin waxes, and paraffin waxes are used. It is important that the wax exudes properly from the molten toner. It is considered that exuding of the wax can prevent adherence of the molten toner to the surface of the fixing roller thereby suppressing the offset phenomenon.

Further, as a second measure, in the toner, external additives for improving and controlling the charged amount and the fluidity are added to a matrix particle incorporated with the binder resin, the colorant, the charge controller, etc.

For the binder resin for use in the full color toner, those resins excellent in the sharp melting property, the coloring property and the fixing property are demanded and polyester resins are used usually. Then, the polyester resins usually show strong negatively charging characteristic and the toner using such resins is designed for negative charging and, as the negative charge controller used for the toner, oil soluble dyes such as oil black and spiron black, metal containing azo dyes, metal naphthenate salts, metal alkyl salicylate salts, fatty acid soaps, and resinic acid soaps, etc. are used.

The external additive includes, for example, fine inorganic powder such as of silicon dioxide, titanium oxide, aluminum oxide, cerium oxide, zinc oxide, tin oxide, and zirconium oxide, those formed by applying a surface treatment to them by using a hydrophobic treating agent such as silicon oil, and silane coupling agent, as well as fine resin powder such as of polystyrene, acrylate, styrene-acrylate, polyester, polyolefin, cellulose, polyurethane, benzoguanamine, melamine, nylon, silicon, phenol, and vinylidene fluoride.

For making the chargeability of the toner excellent, it has been known that uniform and fine dispersion of the charge controller in the toner particle or on the surface of the toner particle is at first important. In a case where the charge controller is agglomerated to a portion in the toner or is not finely particulated even if it is dispersed uniformly and present as coarse particles, initial charged amount can not be obtained. Further, in a case where the charge controller is not dispersed, the rising characteristic of charging is poor or a toner with remarkable decay of charging is formed. Accordingly, various devices have been conducted for uniformly and finely dispersing the charge controller in the toner, and selection for the kind and the chemical composition of the binder resin is an important factor. Accordingly, in order to make the charging characteristic of the toner excellent, it is important not only using a charge controller of excellent charging characteristic but also selecting and using a binder resin capable of uniformly and finely dispersing the charge controller in accordance with the charge controller to be used.

Then, as the external additive for improving the chargeability, the fluidity, the adhesion, or the like, a fine powder of an inorganic oxide is generally added, that is, fine silica particles are generally added to toner matrix particles, to obtain a toner. However, in a case of fine silica particles used usually, while they are particularly excellent in the effect of improving the toner fluidity, they have a strongly negative polarity and, particularly, in a low temperature and low humidity circumstance, they excessively increase charges of the negatively charging toner.

Further, under high temperature and high humidity, since they absorb water content to decrease the chargeability, it results in a great difference of the chargeability between the low temperature and low humidity condition and high temperature and high humidity condition, so that the transportability of the toner to the developer support and the chargeability thereof can not be optimized both for high temperature and high humidity and low temperature and low humidity conditions to result in the problem of failure in the reproducibility of image density, fogging, dropping of toner and, further, contamination inside the machine.

With an aim of improving them, fine silica particles applied with a surface treatment by an amino compound for moderating the effect of negative charging are used. However, no satisfactory effect of reducing the difference of the charged amount depending on the circumstance can be obtained only by the use of fine silica particles and no sufficient effect is obtained in a case of using a polyester resin as the binder resin in the toner matrix particles. In a case where a sufficient chargeability can be provided under high temperature and high humidity, the charged amount increases excessively under low temperature and low humidity and the distribution of charging is widened remarkably and, particularly, lowering of the developability and increase of fogging are ferocious.

Accordingly, as a method of eliminating the circumstantial fluctuation of the toner particle characteristics, a method of applying a surface treatment with a hydrophobic treating agent such as a silicone oil or a silane coupling agent is utilized.

As described above, even when a hydrophobic treatment, or a treatment of moderating negatively charging property is applied to fine silica particles, dependence of charging on the circumstance, charging rate and the poor distribution of charges inherent to silica have not yet been improved at present.

In view of the above, external addition of inorganic compounds other than the fine silica particles to the toner has been studied and titanium oxide or the like has become used. Titanium oxide has a low charging level and has a merit that the charging level and the circumstantial dependence can be controlled easily by using a treating agent. However, titanium oxide is generally obtained by a method of taking out titanium oxide crystals using ilmenite ores by a sulfuric acid method and, since titanium oxide is obtained by heating and baking after purification by a wet method, and chemical bonds formed by dehydrating condensation reaction are naturally present in titanium oxide, strong agglomerates are present therein. Such agglomerated particles can not be easily redispersed by the existent method. That is, crystalline titanium oxide obtained as a fine powder contains secondary agglomerates and tertiary agglomerates and the effect of improving the fluidity of the toner was extremely lower compared with that of silica.

Further, a demand for improving the image quality has been increased, particularly, color photography, etc., and it has been attempted to attain high image quality by making the particle size of the toner smaller but refining of the toner matrix particles increases the inter-particle adhesion and lowers the fluidity of the toner further. The phenomenon tends to occur, particularly, in titanium oxide.

Accordingly, it has been known to use and add hydrophobic titanium oxide and hydrophobic silica together to toner particles in order to make the improvement of the fluidity and the circumstantial dependence of charging compatible for the toner.

With regard to the first measure, for overcoming the problem in the charging characteristic and the fixing characteristic of the toner, a technique as described, for example, in Japanese Unexamined Patent Publication JP-A 2004-4207 has been proposed. JP-A 2004-4207 proposes a technique of incorporating an organic bentonite as a charge controller in a polyester resin having an aliphatic alcohol ingredient as a binder resin, thereby enhancing uniform and fine dispersibility of the charge controller in the toner to improve the charging characteristic of the toner. Further, it discloses to use, particularly, those waxes containing higher fatty acid ester compounds and/or aliphatic alcohol compounds to the polyester resin having the aliphatic alcohol ingredient as a releasing agent. Improvement of the charging characteristic and the fixing characteristic have been intended by using them.

Since polyester resin having the aliphatic alcohol ingredient used as the binder resin disclosed in JP-A 2004-4207 is inferior in the humidity resistant circumstantial characteristic to the polyester resins having aromatic alcohol ingredient, it is expected that no sufficient charging stability can be obtained. Therefore, as images are formed repetitively, it gives rise to a problem such as contamination of images or contamination inside the machine by toner scattering, etc.

Further, the wax containing the higher fatty acid ester compound and/or aliphatic alcohol compound is highly compatible with the polyester resin having the aliphatic alcohol ingredient and has good dispersibility. However, the wax is poor in view of the exuding effect from the toner and no satisfactory offset resistance and fixing strength can be expected. The anti-offset characteristic and the fixing characteristic are extremely important factors.

Further, with regard to the second measure, JP-A 2004-4207 discloses therein to use silica and titanium oxide subjected to a hydrophobic treatment as an external additive. It is disclosed that the charging characteristics, etc. can thus be improved, images with no background contamination can be obtained even in high speed development, toner scattering inside the developing apparatus can be decreased and stable images can be obtained from the initial state to the completion of development.

By the way, JP-A 2004-4207 neither discloses nor suggests the optimization of the external additive for charge control and it mentions nothing at all about the stability of the image quality due to circumstantial change or the like or suppression of change for the image density.

SUMMARY OF THE INVENTION

In view of the above, an object of the invention is to provide an electrophotographic toner not undergoing the effect of temperature and humidity even by repetitive development in continuous use, and excellent in the charging stability for reproducing stable images for a long time. The invention also intends to provide an electrophotographic toner also excellent in the fixing property and the releasability.

Further, another object of the invention is to provide an electrophotographic toner at least excellent in the transparency and capable of improving the color reproducibility in a case of use as a color toner.

The invention intends to attain the foregoing object by providing an electrophotographic toner of excellent charging stability and fluidity by optimization of an external additive for charge control.

Hence, the invention provides an electrophotographic toner comprising at least a binder resin, a colorant, a charge controller, and a wax, wherein the binder resin is a polyester resin having an aromatic alcohol ingredient, the charge controller is an organic bentonite and the wax is a non-polar paraffin wax.

According to the toner having the constitution as described above, a toner in which a charge controller can be dispersed uniformly and finely in the toner without deteriorating the characteristics of the polyester resin, and which is excellent in the charging stability, can exude the wax efficiently upon fixing and provide good fixing property can be obtained by incorporating the specified charge controller and the non-polar paraffin wax in the polyester resin having the aromatic alcohol ingredient as the binder resin.

For example, compared with a case of a polyester resin having an aliphatic alcohol ingredient, in the polyester resin having the aromatic alcohol ingredient, the resistance of the toner less changes by the change of the external circumstance and the charged amount can be controlled easily, and the charging characteristic (life characteristic) is stabilized even by repetitive development in continuous use. The difference is greatly attributable to the chemical structure of the resin, and the polyester resin having the aromatic polyester resin is more hydrophobic and, accordingly, has higher humidity resistance than the polyester resin having the aliphatic alcohol ingredient.

Further, by incorporating the organic bentonite as the charge controller to the resin and, further, incorporating a non-polar paraffin wax as a wax to the mixture, the wax can exude efficiently from the toner upon fixing, the releasability to the toner can be improved and the fixing temperature region can be extended. This is the effect of the compatibility of the non-polar paraffin wax to the mixture of the resin and the organic bentonite as the charge controller, and the non-polar paraffin wax has an appropriately low compatibility with the mixture, is finely dispersed in the toner, and exudes efficiently from the molten toner during fixing. Thus, in a case of using a fixing roller, etc. as a fixing device, the wax intrudes between the molten toner and the fixing roller, so that even a molten toner of low cohesion rendered viscosity being lowered for attaining color reproducibility does not adhere to the fixing roll, and high temperature offset can be prevented. Further, also at low temperature, adhesion with the transfer paper is strengthened with the anchoring effect due to exuding of the wax and low temperature offset can be prevented.

In the invention, it is preferable that a volume average particle size $D_{50}$ of the charging controller is 9 μm or less.

In the invention, it is preferable that a differential scanning calorimeter absorption peak temperature of the wax is in a range of from 68° C. to 103° C.

In the invention, it is preferable that an addition amount of the charging controller is in a range of from 0.4% by weight to 6% by weight based on an entire amount of the toner.

In the invention, it is preferable that an addition amount of the wax is in a range of from 0.7% by weight to 11% by weight based on the entire amount of the toner.

In the invention, it is preferable that an acid value of the binder resin is in a range of from 4 mgKOH/g to 31 mgKOH/g.

In the invention, it is preferable that the charging controller has a salt structure comprising an alkaline bentonite and an organic cation.

Furthermore, the invention provides an electrophotographic toner comprising a toner matrix particles containing at least a binder resin, a colorant and a charge controller, and an external additive, wherein the binder resin contains a polyester resin formed by reacting an aromatic alcohol ingredient, the charge controller contains an organic bentonite, and the external additive contains metatitanic acid subjected to a hydrophobic treatment.

According to the toner comprising the constitution as described above, an electrophotographic toner with less circumstantial fluctuation of charging and less fluctuation of charging during repetitive development in continuous use (excellent life charging stability) and capable of reproducing uniform images with stable density can be obtained by incorporating the specified charge controller in the polyester resin formed by reacting the aromatic alcohol ingredient as the binder resin thereby capable of uniformly and finely dispersing the charge controller in the toner without deteriorating the characteristic of the polyester resin and by using an external additive containing metatitanic acid subjected to a hydrophobic treatment thereby capable of stabilizing the distribution of charged amount and the fluidity.

Further, a toner having good fluidity even by repetitive development in continuous use and sharp distribution of the charged amount can be provided by incorporating the organic bentonite as the charge controller to the resin and using an external additive containing metatitanic acid subjected to a hydrophobic treatment capable of uniformly depositing in a state approximate to primary particles to the surface of toner matrix particles as an optimized external additive to the charge controller.

In the invention, it is preferable that a volume average particle size $D_{50}$ of the organic bentonite is 9 μm or less.

In the invention, it is preferable that a hydrophobic treating agent of the hydrophobic treatment for the metatitanic acid is an alkoxy silane.

In the invention, it is preferable that an addition amount of the organic bentonite is in a range of from 0.4% by weight to 6% by weight based on the entire amount of the toner.

In the invention, it is preferable that a volume average particle size of the metatitanic acid subjected to a hydrophobic treatment is in a range of from 30 μm to 50 μm.

In the invention, it is preferable that the acid value of the polyester resin formed by reacting the aromatic alcohol ingredient is in a range of from 4 mgKOH/g to 31 mgKOH/g.

In the invention, it is preferable that an addition amount of the metatitanic acid subjected to a hydrophobic treatment is in a range of from 0.3% by weight to 2% by weight based on the entire amount of the toner.

In the invention, it is preferable that the organic bentonite has a salt structure comprising an alkaline bentonite and an organic cation.

In the invention, it is preferable that the external additives of the electrophotographic toner further comprises a silica subjected to a hydrophobic treatment.

DETAILED DESCRIPTION OF THE PREFERRED EMBODIMENTS

Preferred embodiments of the invention are described below.

For the binder resin constituting the electrophotographic toner according to the invention, known polyester resins having aromatic alcohol ingredient can be used and one or more of them can be used in combination.

The binder resin constituting the electrophotographic toner according to the invention is to be described. The aromatic alcohol ingredient in the polyester resin as the binder resin according to the invention includes, for example, bisphenol A, polyoxyethylene-(2.2)-2,2-bis(4-hydroxyphenyl) propane, polyoxyethylene-(2.0)-2,2-bis(4-hydroxyphenyl) propane, polyoxypropylene-(2.0)-2,2-bis(4-hydroxyphenyl) propane, polyoxypropylene-(2.2)-polyoxyethylene-(2.0),-2,2-bis(4-hydroxyphenyl) propane, polyoxypropylene-(6)-2,2-bis(4-hydroxyphenyl) propane, polyoxypropylene-(2.2)-2,2-bis(4-hydroxyphenyl) propane, polyoxypropylene-(2.4)-2,2-bis(4-hydroxyphenyl) propane, polyoxypropylene-(3.3)-2,2-bis(4-hydroxyphenyl) propane, and derivatives thereof.

Further, the polybasic acid ingredient in the polyester resin includes, for example, dibasic acids such as succinic acid, adipic acid, sebasic acid, azelaic acid, dodecenyl succinic acid, n-dodecyl succinic acid, malonic acid, maleic acid, fumaric acid, citraconic acid, itaconic acid, glutaconic acid, cyclohexane dicarboxylic acid, ortho-phthalic acid, isophthalic acid, and terephthalic acid, tri- or higher basic acids such as trimellitic acid, trimethinic acid, and pyromellitic acid, as well as anhydrides and lower alkyl esters thereof. With a view point of heat resistant cohesion, terephthalic acid or lower alkyl esters thereof are preferred.

The acid value of the polyester resin constituting the electrophotographic toner of the invention is preferably within the range as described below. For example, the acid value of the polyester resin is preferably from 5 to 30 mgKOH/g. In a case where the acid value is less than 5 mgKOH/g, the charging characteristic of the resin is lowered, and the organic bentonite as the charge controller is less dispersible in the polyester resin. They give undesired effects on the rising of the charged amount and the stability of the charged amount by repetitive development in continuous use.

Further, in a case where the acid value is 2 mgKOH/g or less, the dispersibility of the organic bentonite is worsened and the charging characteristic of the resin is further lowered. Further, the pigment dispersion is also degraded to narrow the color reproducibility.

On the other hand, in a case where the acid value exceeds 35 mgKOH/g, moisture absorption under high temperature and high humidity circumstance increases to increase the water content. This lowers the resistance of the toner and the stable control for the charged amount relative to the circumstantial change is difficult even when the charge controller is added, and the charging characteristic by repetitive development in continuous use is not stabilized as well.

The acid value was measured according to the method as described in JIS K 0070-1992.

The melting temperature of the polyester resin constituting the electrophotographic toner of the invention described above is one of important factors for obtaining transparency. For example, in a case of use as a color toner, it is necessary to sufficiently melt the toner such that boundary between each of the toners is eliminated when toners of respective colors are superposed. Also for this purpose, the melting temperature of the polyester resin is preferably from 90° C. to 135° C. In a case where the melting temperature of the binder resin is lower than 90° C., the toner cohesion lowers excessively tending to cause high temperature offset. Further, in a case where it is higher than 135° C., it is difficult to eliminate the boundary of the boundary toner particles between the particles to obtain a sufficient transparency. In the case of a black toner, the melting temperature from 90° C. to 160° C. may also be used.

The melting temperature of the resin as described above is defined as a temperature at a ½ stroke when measured by using a flow tester CFT-500 type (manufactured by Shimazu Seisakusho) under the conditions with an amount of a sample of 1.0 g, and a die dimension of 1.0×1.0, under an extrusion load of 20 kgf/cm$^2$, at a temperature elevation rate of 6° C., and at an initial temperature of 60° C. and for a pre-heating time of 300 sec.

Then, the charge controller constituting the electrophotographic toner according to the invention is to be described. An organic bentonite is used as the charge controller. The organic bentonite is a material prepared by using an organic cation forming compound and bentonite as the main ingredient. Bentonite is a clay mineral having a layered structure mainly comprising $SiO_2$ and $Al_2O_3$ and montmorillonite as a main ingredient. Bentonite as the natural layered compound can take organic molecules between the layers by ion exchange or the like. Cations of inorganic metals such as sodium or potassium are present inherently between the layers of bentonite and, by ion exchanging them, organic cations such as alkyl ammonium ions are intercalated to form a composite body in which organic and inorganic materials are laminated alternately (inter layer compound). The organic bentonite used as the charge controller in the invention is formed by exchanging inorganic cations in bentonite with organic cations derived from organic cation-forming compounds.

As organic cation forming compound for preparing the organic bentonite, known compounds can be used. For example, they include quaternary ammonium salts such as dodecyl trimethyl ammonium chloride, lauryl trimethyl ammonium chloride, hexadecyl trimethyl ammonium chloride, dodecyl ammonium chloride, dodecyl ammonium bromide, dimethyl distearyl ammonium chloride, stearyl dimethylbenzyl ammonium chloride, tetrabutyl ammonium chloride, tetrapentyl ammonium fluorophosphate, tetraethyl ammonium benzoate, tetraethyl ammonium acetate, tetrabutyl ammonium iodide, and triethylmethyl ammonium iodide.

They further include pyridium salts such as isopropyl pyridinium chloride, butyl pyridinium chloride, heptyl pyridinium chloride, deceyl pyridinium chloride, dodecyl pyridinium bromide, and cetyl pyridinium chloride.

They further include polymeric ammonium salts obtained, for example, from polyalkylene imine such as polyethylene imine, poly-(4-vinylpyridine), polyallylamine, aminoacetylated polyvinyl alcohol, poly-(L)-lysine, chitosan, polypyrrole, or copolymer with a vinyl monomer containing an amino group containing acrylate such as diethylaminoethyl methacrylate.

The anion ingredient in the organic cation forming compound for preparing the organic bentonite is not particularly limited and, anions not containing heavy metals such as, chromium, cobalt, copper, nickel, molybdenum, lead, and mercury are preferred with a view point of safety and environmental preservation.

The method of preparing the organic bentonite used in the invention is not particularly limited and the organic bentonite can be prepared by an ion exchanging operation used so far. For example, it can be obtained by immersing bentonite in water, a mixture of water and an organic solvent, or an organic solvent, adding an organic cation forming compound thereto, leaving them for a predetermined of time, then filtering, washing and then drying them.

Further, the organic bentonite used in the invention preferably has a salt structure comprising an alkaline bentonite and an organic cation. This can result in a function of providing the chargeability to a toner even with a little amount.

The organic bentonite as the charge controller used in the invention can improve the charging characteristic of the toner by enhancing the dispersibility (uniform dispersion) in the polyester resin as the binder resin as described above. Also for this purpose, the volume average particle size $D_{50}$ of the organic bentonite is preferably controlled to 8 μm or less. This can render the charge controller to be present substantially uniformly with a fine particle size on the surface of the toner and less separating from the toner particles to provide a toner excellent in the rising characteristic of the charged amount and in the life stability of the charged amount. In a case where the volume average particle size $D_{50}$ exceeds 8 μm, while the charge controller is uniformly dispersed in the toner, the size becomes not uniform to decrease the charging efficiency somewhat. Accordingly, the volume average particle size $D_{50}$ is preferably about 8 μm or less. In a case where it is intended to be pulverized finely to 1 μm or less for the volume average particle size $D_{50}$, since this requires considerable time and energy, the productivity is worsened to increase the cost. However, those with a volume average particle size $D_{50}$ of 1 μm or less can also be used considering the dispersibility and so long as the purpose of the invention can be attained. Further, in a case of intending to prepare the toner at a reduced cost, those with a volume average particle size $D_{50}$ of 1 μm or more may be used.

The organic bentonite in the invention also gives a significant effect on the charging characteristic and color reproducibility in color toners depending on the addition amount thereof. Accordingly, the addition amount of the organic bentonite is preferably from 0.5% by weight to 5% by weight based on the entire amount of the toner. For example, in a case where the addition amount is less than 0.5% by weight, this tends to degrade the image quality or cause toner scattering in the apparatus by the lowering of the rising characteristic and worsening of the life stability of the charged amount of the toner. Further, since the color reproducibility of the toner begins to be lowered in a case where the addition amount exceeds 5% by weight, this is not desirable. A more preferred range is from 0.8% by weight to 3% by weight. Within the range described above, the color reproducibility is improved and lowering of the charging performance less tends to occur.

Further, while known charge controller may also be used together in the invention, since the charge controller used in the invention is a negatively charging charge controller, in a case of using other charge controller together, it is preferably a negatively charging controller.

In a first embodiment of the invention, as the wax for constituting the electrophotographic toner of the invention, a non-polar paraffin wax is used for attaining the purpose of the invention. The wax has a range of DSC (differential canning calorimeter) absorption peak temperature preferably from 70° C. to 100° C. In a case where the DSC peak temperature of the wax is 70° C. or lower, the viscosity is lowered and the high temperature offset property and storability are worsened. On the other hand, in a case where it is 100° C. or higher, the exuding effect is lowered and the fixing region is narrowed. The DSC peak temperature measurement is conducted, for example, by DSC 200 manufactured by Seiko Instruments Co. A process of elevating the temperature from 20° C. to 200° C. at a rate of 10° C. per one min and then lowering the temperature from 200° C. to 20° C. is repeated twice as the measuring condition and the heat absorption peak therein is measured.

Further, the wax used in the invention also gives an effect on the charging characteristic, etc. as described below depending on the addition amount. Accordingly, the addition amount of the wax is preferably within a range from 1% by weight to 10% by weight based on the entire amount of the toner. In a case where the addition amount of the wax mixture is less than 1% by weight, the effect of the wax is lowered and in a case where it exceeds 10% by weight, degradation of the charging property, etc. tends to start. It is more preferably, 2% by weight to 8% by weight. In a case where the addition amount of the wax is 2% by weight or more, the non-offset region is widened and, in a case where it is 8% by weight or less, free wax less occurs in the developer during repetitive development (life) in continuous use.

Further, in the second embodiment of the invention, the toner matrix particles constituting the electrophotographic toner may be incorporated with known waxes. The waxes can be used each alone or two or more of them may be used in combination. Specifically, the wax includes petroleum waxes such as paraffin wax, oxidized paraffin wax, and microcrystalline wax, mineral waxes such as montan wax, animal and plant waxes such as bees wax and carnauba wax, and synthetic waxes such as polyolefin wax (polyethylene, polypropylene, etc.), oxidized polyolefin wax, and Fisher-Tropsch wax, with no particular restriction to them.

The wax can be incorporated to the binder resin by from 0.1 to 15% by weight and, preferably, from 1 to 10% by weight, and can provide good fixing offset performance. In a case where the content is 0.1 parts by weight or less, the anti offsetting property tends to be deteriorated and, on the other hand, in a case where it is 15% by weight or more, the fluidity of the toner tends to be worsened.

In the foregoing descriptions, additives contained in the particles as the toner matrix have been described in various ways, external additives to be added in addition to the toner matrix particles for attaining the purpose of the invention are to be described. The external additives used in the invention are metatitanic acid subjected to a hydrophobic treatment.

The external additives are prepared by a sulfuric acid method shown below using ilmenite ores as the starting material.

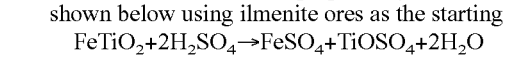

$FeTiO_2+2H_2SO_4 \rightarrow FeSO_4+TiOSO_4+2H_2O$

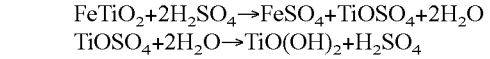

$TiOSO_4+2H_2O \rightarrow TiO(OH)_2+H_2SO_4$

The external additives is obtained by adding a silane compound to an aqueous dispersion of $TiO(OH)_2$ (metatitanic acid) obtained by the method described above and treating at least a portion (a portion or entire portion) of hydroxyl groups in $TiO(OH)_2$. As described above, by conducting reaction in the solution, the silane compound is hydrolyzed, and hydroxyl groups of $TiO(OH)_2$ particles dispersed uniformly in the solution and the hydrolyzed silane compound are reacted. As a result, metatitanic acid subjected to the hydrophobic treatment with the silane compound is formed from $TiO(OH)_2$ in the state of primary particles. This enable to obtain titanium in a primary particle state with no agglomeration. Further, in the reaction described above, delicate control for the specific gravity and the negatively charging property can be controlled by the kind of the silane compound and the amount thereof to be treated.

As the silane compound, an alkoxy silane or chloro silane type can be used. Specifically, the silane compound includes, for example, i-butyltrimethoxy silane, n-propyltrimethoxy silane, n-hexyltrimethoxy silane, ethyltrimethoxy silane, methyltrichloro silane, and trimethylchloro silane and, among all, i-butyltrimethoxy silane is particularly preferred as the treating agent in the invention. Further, the external additive is used in an amount from 0.3% by weight to 2% by weight based on the entire amount of the toner. In a case where it is less than 0.3% by weight, lowering of the image quality or the toner scattering in the apparatus tend to occur due to the worsening of the chargeability. In a case where it is 2% by weight or more, the color reproducing range becomes narrower. Further, the volume average particle size is preferably within a range from 30 to 50 nm with a view point of fluidity. In a case where it is less than 30 nm, worsening of the transfer efficiency occurs. At the particle size of 50 nm or more, it tends to be li The binder resin, the charge controller, and the wax used in the invention for constituting the electrophotographic toner have been described above. Together with the constituent materials, a colorant is further added for determining the color of the toner. For the colorant, that is, colorants constituting toners for respective colors, for example, toners for respective colors such as yellow, magenta, cyan, and black, those known so far can be used. Further, the colorants can be used each alone or in combination of two or more of them for each of the colors.

The colorant for obtaining an yellow toner includes, for example, C. I. Pigment Yellows:

1, 3, 4, 5, 6, 12, 13, 14, 15, 16, 17, 18, 24, 55, 65, 73, 74, 81, 83, 87, 93, 94, 95, 97, 98, 100, 101, 104 108, 109, 110, 113, 116, 117, 120, 123, 128, 129, 133, 138, 139, 147, 151, 153, 154, 155, 156, 168, 169, 170, 171, 172, 173, 180, and 185. Among them, C. I. Pigment Yellows 17 (disazo), 74 (monoazo), 155 (condensed azo), and 180 (benzimidazolone) are particularly preferred.

Further, the colorant for obtaining a magenta toner includes, for example, C. I. Pigment Reds 1, 2, 3, 4, 5, 6, 7, 8, 9, 10, 12, 14, 15, 17, 18, 22, 23, 31, 37, 38, 41, 42, 48:1, 48:2, 48:3, 48:4, 49:1, 49:2, 50:1, 52:1, 52:2, 53:1, 53:3, 54, 57:1, 58:4, 60:1, 63:1, 63:2, 64:1, 65, 66, 67, 68, 81, 83, 88, 90, 90:1, 112, 114, 115, 122, 123, 133, 144, 146, 147, 149, 150, 151, 166, 168, 170, 171, 172, 174, 175, 176, 177, 178, 179, 185, 187, 188, 189, 190, 193, 194, 202, 208, 209, 214, 216, 220, 221, 224, 242, 243, 243:1, 245, 246, and 247. Among them, C. I. Pigment Reds 48:1 (barium red), 48:2 (calcium red), 48:3 (strontium red), 48:4 (manganese red), 53:1 (lake red), 57:1 (brilliant carmine), 122 (quinacridone magenta), and 209 (dichloroquinacridone red) are particularly preferred.

Further, the colorant for obtaining a cyan toner includes phthalocyanine type C. I. Pigment Blues:

1, 2, 15:1, 15:2, 15:3, 15:4, 15:6, 15, 16, 17:1, 27, 28, 29, 56, 60 and 63. Among all, C. I. Pigment Blues 15:3 (phthalocyanine blue G), 15 (phthalocyanine blue R), 16 (non-metal phthalocyanine blue), and 60 (indanthrone blue) are particularly preferred.

Further, as the colorant for obtaining the black toner, carbon blacks are suitable. The carbon black may be selected properly from various known carbon blacks such as channel black, ROSE black, disk black, gas furnace black, oil furnace black, and acetylene black.

The content of the colorant is preferably from 2% by weight to 20% by weight. Within the range described above, high density images uniform for the entire images and excellent in the transparency, the coloring power, the color reproducibility, and the fixing property can be obtained. At the pigment density of less than 2% by weight, while the transparency is good, sufficient coloring power is not provided and uniform high density images can not be obtained. Further, the content exceeding 20% by weight is not suitable to actual use since no sufficient color reproducing region can be ensured due to insufficiency of lightness and saturation, the fixing strength is deteriorated due to the decrease of the resin ingredient. It is more preferably from 2% by weight to 15% by weight. Within the range described above, sufficient color reproducibility can be ensured and the fixing property is less degraded.

For the electrophotographic toner according to a first embodiment of the invention, various external additives such as fluidizing agent and surface resistance controller can be used optionally. The external additives usable in the invention include, for example, fine inorganic powder such as of silicon dioxide, titanium oxide, aluminum oxide, cerium oxide, zinc oxide, tin oxide, and zirconium oxide, and those formed by applying a surface treatment with a hydrophobic treating agent such as silicon oil or silane coupling agent to them, as well as fine resin powder of polystyrene, acryl, styrene acryl, polyester, polyolefin, cellulose, polyurethane, benzoguanamine, melamine, nylon, silicon, phenol, and vinylidene fluoride. They may be used each alone or two or more of them may be used in combination.

The electrophotographic toner according to the invention may be used alone, or may also be used as a two-component developer by mixing the toner particles of the invention and a carrier.

As the carrier, magnetic material particles coated with resins are generally used and they can also be used in the invention. As the resin for coating the carrier surface, styrene-acrylate ester copolymer, styrene-methacrylate ester copolymer, acrylate ester copolymer, methacrylate ester copolymer, silicon resin, fluoro-containing resin, polyamide resin, ionomer resin, polyphenylene sulfide resin, and mixtures thereof can be used.

As the magnetic material for the carrier core, oxides such as ferrite, iron excess type ferrite, magnetite, and γ-oxide iron, metals such as iron, cobalt and nickel, or alloys thereof can be used. Further, elements contained in the magnetic materials include, for example, iron, cobalt, nickel, aluminum, copper, lead, magnesium, tin, zinc, antimony, beryllium, bismuth, cadmium, calcium, manganese, selenium, titanium, tungsten, and vanadium.

Further, as the carrier, magnetic material particles coated with resins are generally used and, in addition, carriers of other forms such as particles only consisting of magnetic materials, magnetic particles dispersed in resin particles, etc. may also be used in the invention.

The electrophotographic toner of the invention can be produced by known methods (kneading pulverization method, chemical method, etc.). In a case of intending to obtain images at high quality and high density, the volume average particle size of the obtained toner is preferably within a range from 4 μm to 8 μm. By decreasing the particle size to such a range, high image density can be obtained with a small deposition amount to provide an effect capable of saving the amount of toner consumption. In a case where the particle size is less than 4 μm, individual particles can not have sufficient chargeability and toner scattering, image fogging, etc. become remarkable and they are not suitable to actual use. Further, in a case where it exceeds 8 μm, the layer thickness of the formed images increases to form images giving remarkable granular feeling, which is not preferred.

EXAMPLE

The invention is to be described more specifically with reference to examples and comparative examples but the invention is not particularly limited to them so long as the gist of the invention is not exceeded.

(As for the Electrophotographic Toner According to a First Embodiment of the Invention)

(1) Preparation Example of Charge Controller 10 g of bentonite at a pH value from 7 to 12 was dispersed in 300 ml of deionized water by stirring at 80° C. for one hour to prepare a liquid bentonite suspension. Then, after controlling 5.3 g of an aqueous solution of distearyldimethylammonium chloride (DSDMAC) at 77% concentration to a pH value of about 9 by using a diluted NaOH solution, it was added to the liquid bentonite suspension, stirred at 80° C. for one hour, separated by filtration, washed several times with deionized water, then dried at 60° C. in vacuum, and applied with a treatment for decreasing the particle size, to obtain charge controllers (organic bentonite) of different volume average particle size $D_{50}$. The volume average particle size $D_{50}$ of the prepared charge controllers are as described in each of examples and comparative examples in the following Table 1.

Example 1

| | |
|---|---|
| Polyester resin (acid value: 21 mg/KOH/g) aromatic alcohol ingredient: PO-BPA and EP-BPA acid ingredient: fumaric acid and mellitic acid anhydride | 87.5 wt % |
| C.I. Pigment Blue 15:1 | 5 wt % |
| Non-polar paraffin wax (DSP peak 78° C., Mw 8.32 × $10^2$) | 6 wt % |
| Charge controller (prepared by the preparation example described above: volume average particle size 2 μm) | 1.5 wt % |

Mw for the non-polar paraffin wax represents a weight average molecular weight as is well-known.

After pre-mixing each of the constituent materials described above by a Henschel mixer, they were melt kneaded by a twin screw extrusion kneader. After coarsely pulverizing the kneading product by a cutting mill, it was finely pulverized by a jet mill and then classified by a pneumatic classifier to prepare a toner with an average particle size of 6.5 μm. Then, 1.0 part by weight of fine silica particles was added as a fluidizing agent to 100 parts by weight of the classified toner, mixed in a Henschel mixer, and applied with external addition to prepare a toner for cyan evaluation.

Example 2

A toner was prepared in the same manner as in Example 1 except for changing the acid value of the polyester resin to 5 mgKOH/g as shown in the following Table 1.

Example 3

A toner was prepared in the same manner as in Example 1 except for changing the acid value of the polyester resin to 28 mgKOH/g as shown in the following Table 1.

Example 4

A toner was prepared in the same manner as in Example 1 except for changing the acid value of the polyester resin to 4 mgKOH/g as shown in the following Table 1.

Example 5

A toner was prepared in the same manner as in Example 1 except for changing the acid value of the polyester resin to 31 mgKOH/g as shown in the following Table 1.

Example 6

A toner was prepared in the same manner as in Example 1 except for changing the volume average particle size of the organic bentonite as the charge controller to 7 μm as shown in Table 1.

Example 7

A toner was prepared in the same manner as in Example 1 except for changing the volume average particle size of the organic bentonite as the charge controller to 9 μm as shown in Table 1.

Example 8

A toner was prepared in the same manner as in Example 1 except for changing the number of parts by weight of the organic bentonite as the charge controller to 0.4% by weight as shown in Table 1.

Example 9

A toner was prepared in the same manner as in Example 1 except for changing the number of parts by weight of the organic bentonite as the charge controller to 0.6% by weight as shown in Table 1.

Example 10

A toner was prepared in the same manner as in Example 1 except for changing the number of parts by weight of the organic bentonite as the charge controller to 4% by weight as shown in Table 1.

Example 11

A toner was prepared in the same manner as in Example 1 except for changing the number of parts by weight of the organic bentonite as the charge controller to 6% by weight as shown in Table 1.

Example 12

A toner was prepared in the same manner as in Example 1 except for changing the DSC peak temperature of the non-polar paraffin wax as the wax to 71° C. as shown in Table 1.

Example 13

A toner was prepared in the same manner as in Example 1 except for changing the DSC peak temperature of the non-polar paraffin wax as the wax to 68° C. as shown in Table 1.

Example 14

A toner was prepared in the same manner as in Example 1 except for changing the DSC peak temperature of the non-polar paraffin wax as the wax to 98° C. as shown in Table 1.

Example 15

A toner was prepared in the same manner as in Example 1 except for changing the DSC peak temperature of the non-polar paraffin wax as the wax to 103° C. as shown in Table 1.

Example 16

A toner was prepared in the same manner as in Example 1 except for changing the number of parts by weight of the non-polar paraffin wax as the wax to 1.5% by weight as shown in Table 1.

Example 17

A toner was prepared in the same manner as in Example 1 except for changing the number of parts by weight of the non-polar paraffin wax as the wax to 0.7% by weight as shown in Table 1.

Example 18

A toner was prepared in the same manner as in Example 1 except for changing the number of parts by weight of the non-polar paraffin wax as the wax to 9% by weight as shown in Table 1.

Example 19

A toner was prepared in the same manner as in Example 1 except for changing the number of parts by weight of the non-polar paraffin wax as the wax to 11% by weight as shown in Table 1.

The toner of the invention by each of the examples prepared as described above and comparative examples for comparison are to be described below.

Comparative Example 1

A toner was prepared in the same manner as in Example 1 except for changing the polyester resin to a polyester resin comprising an aliphatic alcohol ingredient as shown in Table 1, that is, alcohol ingredient: ethylene glycol, diethylene glycol, and neopentyl glycol, acid ingredient: naphthalene dicarboxylic acid and terephthalic acid.

Comparative Example 2

A toner was prepared in the same manner as in Example 1 except for changing the charge controller to a zirconium compound of salicylic acid as shown in Table 1.

Comparative Example 3

A toner was prepared in the same manner as in Example 1 except for changing the charge controller to a zinc compound of salicylic acid as shown in Table 1.

Comparative Example 4

A toner was prepared in the same manner as in Example 1 except for changing the wax to carnauba wax as shown in Table 1.

Comparative Example 5

A toner was prepared in the same manner as in Example 1 except for changing the wax to polyethylene as shown in Table 1.

Toners of Examples 1 to 19 and Comparative Examples 1 to 5 prepared as described above, and a silicon coated ferrite core carrier with an average particle size of 60 μm were formulated to a toner concentration of 5% by weight to prepare two-component developers.

In the following Table 1, the particle size represents the volume average particle size $D_{50}$, and the number of parts represents % by weight. Further, the organic bentonite has a salt structure comprising an alkaline bentonite and an organic cation, which was obtained in the preparation examples.

TABLE 1

| | Polyester resin | | | Charge controller | | Wax | | |
|---|---|---|---|---|---|---|---|---|
| | Alcohol ingredient | Acid value | Compositions | Particle size $D_{50}$ (μm) | Number of parts (wt %) | Composition | DSC peak temperature (° C.) | Number of parts (wt %) |
| Example 1 | Aromatic | 21 | Organic bentonite | 2 | 1.5 | Paraffin | 78 | 6 |
| Example 2 | Aromatic | 5 | Organic bentonite | 2 | 1.5 | Paraffin | 78 | 6 |

TABLE 1-continued

| | Polyester resin | | | Charge controller | | Wax | | |
|---|---|---|---|---|---|---|---|---|
| | Alcohol ingredient | Acid value | Compositions | Particle size $D_{50}$ (μm) | Number of parts (wt %) | Composition | DSC peak temperature (° C.) | Number of parts (wt %) |
| Example 3 | Aromatic | 28 | Organic bentonite | 2 | 1.5 | Paraffin | 78 | 6 |
| Example 4 | Aromatic | 4 | Organic bentonite | 2 | 1.5 | Paraffin | 78 | 6 |
| Example 5 | Aromatic | 31 | Organic bentonite | 2 | 1.5 | Paraffin | 78 | 6 |
| Example 6 | Aromatic | 21 | Organic bentonite | 7 | 1.5 | Paraffin | 78 | 6 |
| Example 7 | Aromatic | 21 | Organic bentonite | 9 | 1.5 | Paraffin | 78 | 6 |
| Example 8 | Aromatic | 21 | Organic bentonite | 2 | 0.4 | Paraffin | 78 | 6 |
| Example 9 | Aromatic | 21 | Organic bentonite | 2 | 0.6 | Paraffin | 78 | 6 |
| Example 10 | Aromatic | 21 | Organic bentonite | 2 | 4 | Paraffin | 78 | 6 |
| Example 11 | Aromatic | 21 | Organic bentonite | 2 | 6 | Paraffin | 78 | 6 |
| Example 12 | Aromatic | 21 | Organic bentonite | 2 | 1.5 | Paraffin | 71 | 6 |
| Example 13 | Aromatic | 21 | Organic bentonite | 2 | 1.5 | Paraffin | 68 | 6 |
| Example 14 | Aromatic | 21 | Organic bentonite | 2 | 1.5 | Paraffin | 98 | 6 |
| Example 15 | Aromatic | 21 | Organic bentonite | 2 | 1.5 | Paraffin | 103 | 6 |
| Example 16 | Aromatic | 21 | Organic bentonite | 2 | 1.5 | Paraffin | 78 | 1.5 |
| Example 17 | Aromatic | 21 | Organic bentonite | 2 | 1.5 | Paraffin | 78 | 0.7 |
| Example 18 | Aromatic | 21 | Organic bentonite | 2 | 1.5 | Paraffin | 78 | 9 |
| Example 19 | Aromatic | 21 | Organic bentonite | 2 | 1.5 | Paraffin | 78 | 11 |
| Comp. Example 1 | Aliphatic | 18 | Organic bentonite | 2 | 1.5 | Paraffin | 78 | 6 |
| Comp. Example 2 | Aromatic | 21 | Zirconium compound of salicylate | — | 1.5 | Paraffin | 78 | 6 |
| Comp. Example 3 | Aromatic | 21 | Zinc compound of salicylate | — | 1.5 | Paraffin | 78 | 6 |
| Comp. Example 4 | Aromatic | 21 | organic bentonite | 2 | 1.5 | Carnauba wax | 83 | 6 |
| Comp. Example 5 | Aromatic | 21 | organic bentonite | 2 | 1.5 | Polyethylene | 86 | 6 |

(2) Evaluation Method for Examples and Comparative Examples is to be Described.

i. Initial Charged Amount

After setting a developer to a commercial copying machine having a two component developing device (AR-C160, manufactured by Sharp Corp.) and rotating idly for 3 min under normal temperature and normal humidity, the developer was sampled and the charged amount was measured by a suction type charged amount measuring apparatus (210H-2A Q/M Meter, manufactured by TREK Co.). It was judged as utilizable in a case where the charged amount was −20 μC/g or more and good in a case where the charged amount was −25 μC/g or more.

ii. Rising Characteristic of Charging

After stirring a 5 ml glass bottle containing 0.95 g of a carrier (silicon coated ferrite core carrier) and 0.05 g of a toner for one min by a rotary culturing machine at 32 rpm, the developer was sampled and the charged amount was measured by the suction type charged amount measuring apparatus. Further, after stirring for 3 min, the charged amount was measured in the same manner. It was judged as utilizable in a case where the absolute value for the difference of charged amount after one min and after 3 min was 7 μC/g or less and as good in a case where the value was 5 μC/g or less.

iii. Decaying Characteristic of Charging

After stirring a 100 ml polyethylene vessel containing 76 g of a carrier (silicon coated ferrite core carrier) and 4 g of a toner by a ball mill at 150 rpm for 60 min, the charged amount of the developer was measured and it was exposed to high temperature and high humidity. The charged amounts of the developer after one day, after 3 day, and after 10 day were measured and it was judged as utilizable in a case where the absolute value for the difference relative to the charged amount at the first day was 7 μC/g or less and as good in a case where the value was 5 μC/g or less.

iv. Life Characteristic of Charging

After setting a developer to a commercial copying machine having a two component developing device (AR-C160, manufactured by Sharp Corp.) and actually copying 50,000 sheets of solid images at normal temperature and normal humidity, the image density for the image area, the whiteness for the non-image area, and the charged amount of the developer were measured. The image density was measured by an X-Rite 938 spectral calorimetric densitometer and it was judged as good in a case where the image density was 1.4 or more. For the whiteness, tristimulus values X, Y, and Z were determined by using a model SZ90 spectral color difference meter manufactured by Nippon Denshoku Industry Co. and it was judged as utilizable in a case where the ΔX value was 0.7 or less and as good in a case where it was 0.5 or less. The charged amount of the developer was judged by a suction type charged amount measuring apparatus and it was judged as utilizable in a case where the absolute value for the difference relative to the initial charged amount was 7 μC/g or less and as good in a case where it was 5 μC/C or less.

v. Fixing Characteristic

A fixing device (oil less system) of a commercial full color copying machine (ARC-260, manufactured by Sharp Corp.) was modified, an external fixing machine capable of freely setting a roller temperature was used, the paper feed rate was set to 120 mm/sec, and the temperature was changed from 100° C. to 230° C. each by 5° C. In this case, an offset phenomenon where images were re-transferred to the non-image area was observed and the temperature at which the images were not re-transferred was defined as a non-offset temperature.

For the non-offset area, it was judged as utilizable where the range was 40° C. or higher and as good where the range was 50° C. or higher.

The result for evaluation from i to v are shown in Table 2. The overall evaluation was conducted by three ranks of "A", "B", and "C".

was eliminated, the transparency was also good and satisfactory, fixing could be conducted. As described above, good results were obtained in all of the items.

Further, Examples 2, 3, 6, 9, 10, 12, 14, 16, and 18 provided good results in all of the items in the same manner as in Example 1.

TABLE 2

| | Charged amount(−μC/g) | | | | | | | | | | | |
|---|---|---|---|---|---|---|---|---|---|---|---|---|
| | | Rising characteristic | | Decaying characteristic | | | | | | | | |
| | Initial stage | After 1 min | After 3 min | First day | after 1 day | after 3 day | after 10 day | Life characteristic 50,000 sheet | Image density | Whiteness | Fixing characteristic | Overall evaluation |
| Example 1 | 32 | 34 | 36 | 30 | 29 | 28 | 28 | 29 | 1.55 | 0.3 | 140-210 | A |
| Example 2 | 25 | 28 | 32 | 24 | 23 | 22 | 22 | 22 | 1.63 | 0.5 | 140-210 | A |
| Example 3 | 35 | 38 | 39 | 33 | 29 | 28 | 28 | 30 | 1.43 | 0.4 | 140-210 | A |
| Example 4 | 22 | 25 | 31 | 20 | 19 | 18 | 18 | 20 | 1.68 | 0.6 | 140-210 | B |
| Example 5 | 39 | 40 | 41 | 37 | 31 | 31 | 30 | 32 | 1.41 | 0.5 | 140-210 | B |
| Example 6 | 31 | 32 | 35 | 28 | 26 | 25 | 25 | 29 | 1.58 | 0.4 | 140-210 | A |
| Example 7 | 29 | 30 | 36 | 27 | 25 | 25 | 24 | 23 | 1.62 | 0.7 | 140-210 | B |
| Example 8 | 24 | 26 | 32 | 23 | 22 | 21 | 21 | 20 | 1.69 | 0.6 | 140-210 | B |
| Example 9 | 28 | 29 | 33 | 26 | 24 | 24 | 23 | 24 | 1.56 | 0.5 | 140-210 | A |
| Example 10 | 33 | 35 | 34 | 31 | 29 | 29 | 29 | 30 | 1.45 | 0.2 | 150-200 | A |
| Example 11 | 34 | 36 | 39 | 32 | 30 | 30 | 30 | 31 | 1.48 | 0.4 | 150-190 | B |
| Example 12 | 31 | 33 | 36 | 31 | 30 | 29 | 29 | 28 | 1.50 | 0.5 | 140-190 | A |
| Example 13 | 33 | 34 | 36 | 31 | 29 | 29 | 28 | 28 | 1.53 | 0.4 | 140-185 | B |
| Example 14 | 32 | 33 | 36 | 32 | 31 | 30 | 30 | 29 | 1.55 | 0.5 | 150-200 | A |
| Example 15 | 29 | 30 | 33 | 28 | 26 | 26 | 26 | 25 | 1.62 | 0.5 | 155-195 | B |
| Example 16 | 31 | 32 | 33 | 30 | 28 | 28 | 28 | 27 | 1.55 | 0.5 | 150-200 | A |
| Example 17 | 35 | 38 | 40 | 38 | 35 | 35 | 35 | 31 | 1.49 | 0.3 | 155-195 | B |
| Example 18 | 25 | 26 | 30 | 23 | 21 | 20 | 20 | 22 | 1.68 | 0.5 | 140-220 | A |
| Example 19 | 21 | 22 | 28 | 20 | 17 | 16 | 16 | 17 | 1.69 | 0.7 | 140-220 | B |
| Comp. Example 1 | 25 | 26 | 32 | 21 | 13 | 12 | 11 | 15 | 1.70 | 0.9 | 140-210 | C |
| Comp. Example 2 | 18 | 20 | 25 | 19 | 15 | 14 | 14 | 13 | 1.71 | 0.9 | 155-185 | C |
| Comp. Example 3 | 17 | 19 | 24 | 18 | 14 | 13 | 13 | 13 | 1.72 | 1 | 155-190 | C |
| Comp. Example 4 | 30 | 33 | 36 | 33 | 27 | 25 | 25 | 24 | 1.55 | 0.5 | 160-195 | C |
| Comp. Example 5 | 25 | 28 | 35 | 24 | 21 | 20 | 20 | 14 | 1.73 | 0.6 | 170-180 | C |

From the results shown in Table 2 above, the cyan toners manufactured by each of Examples 1 to 19 according to the invention were excellent in both of the charging characteristic and the fixing characteristic and could keep stable development as described below compared with the cyan toners shown in Comparative Examples 1 to 5.

For example, the electrophotographic toner according to Example 1 of the invention showed the initial charged amount of −32 μC/g showing a value of −25 μC/g or more as shown in Table 2. Further, the rising characteristic of the charging was −34 μC/g after stirring for one min and −36 μC/g after stirring for 3 min, in which the difference of the absolute amount of the charged amount was 5 μC/g or less. Further, the decaying characteristic was −30 μC/g at the first day and −28 μC/g after ten days, in which the difference of the absolute amount of the charged amount was 5 μC/g or less. The charged amount after actual copying of 50,000 sheets was −29 μC/g, and the difference relative to the initial charged amount was 5 μC/g or less. The image density was 1.55, i.e., 1.4 or more and the whiteness was 0.3, i.e., 0.5 or less. As described above, it can be said that the toner was excellent in the charging characteristic.

Further, the range where the low temperature offset and the high temperature offset did not occur in a case of melting and fixing the toner (fixing characteristic) was from 140 to 210° C., i.e., 50° C. or higher. In view of the above, the toner was sufficiently melted, the boundary between the toner particles In Example 4, since the acid value of the resin was as low as 4 mgKOH/g, while the charging characteristic was somewhat lowered compared with Example 1, the initial charging characteristic, rising characteristic of charging were each in a utilizable region suitable enough to actual use.

In Example 5, since the acid value of the resin was as high as 31 mgKOH/g, while the decay of the charged amount increased under high temperature and high humidity compared with Example 1, it was in a utilizable region suitable enough to actual use.

Further, in Example 7, since the volume average particle size of the organic bentonite was increased as 9 μm, while the charging characteristic was worsened compared with Example 1, the rising characteristic of charging was sufficient and it can be said that also the whiteness was in a utilizable region.

In Example 8, since the addition amount of the organic bentonite was decreased as 0.4% by weight, while the charging characteristic was somewhat lowered compared with Example 1, the initial charged amount, the rising characteristic of charging and the whiteness were each in a sufficiently utilizable region in view of the judgement for the performance.

In Example 11, since the addition amount of the organic bentonite was increased as 6% by weight, while the fixing property was somewhat lowered compared with Example 1, there was no trouble for other charging characteristics and they were in sufficiently utilizable regions.

Further, in Example 13, since the DSC peak temperature of the non-polar paraffin wax was lowered as 68° C., while the viscosity of the molten toner was lowered and the fixing characteristic on the side of the high temperature was somewhat lowered compared with Example 1, it was in a sufficiently utilizable region in view of the judgement for the performance.

In Example 15, since the DSC peak temperature of the non-polar paraffin wax was increased as 103° C., while the viscosity of the molten toner was increased and the fixing characteristic on the side of the high temperature side and on the low temperature side was somewhat lowered compared with Example 1, it was in a sufficiently utilizable region in view of the judgement for the performance.

In Example 17, since the content of the non-polar paraffin wax was small as 0.7% by weight, while the exuding amount from the toner was decreased and the fixing characteristic on the high temperature side and the low temperature side was lowered compared with Example 1, it was in a sufficiently utilizable region in view of the judgement for the performance.

In Example 19, since the content of the non-polar paraffin wax increased as 11% by weight, while the charging characteristic was somewhat lowered due to the increase in the amount of the wax present at the toner surface and that of free wax, the initial charged amount, the rising characteristic of charging, and the whiteness were each in a sufficiently utilizable region in view of the judgement for the performance.

As described above, by the use of the polyester resin having the aromatic alcohol ingredient, the circumstantial humidity characteristic is excellent and the charge decaying ratio at high temperature and at high humidity was decreased. Further, since the organic bentonite and the non-polar paraffin wax were incorporated in the resin, the initial charged amount and the rising of charged amount of the toner showed appropriate characteristics by the organic bentonite finely dispersed in the toner and the life stability was also improved. Further, in the constitution, the non-polar paraffin wax can exude efficiently from the toner, and the fixing region can be extended from low temperature to high temperature.

On the contrary, in Comparative Example 1, since the polyester resin having the aliphatic alcohol ingredient was used, decay of the charged amount under high temperature and high humidity was large and, further, images with background fogging of high whiteness were formed and no satisfactory results could be obtained compared with the toners of Examples 1 to 19 of the invention.

In Comparative Examples 2 and 3, since charge controllers other than organic bentonite were used, the initial charged amount was lowered to form images with background fogging of high whiteness and, in addition, the fixing characteristic was also worsened failing to obtain satisfactory results.

Further, in Comparative Example 4, since the ester type carnauba wax was used as the wax, decay of the charged amount under high temperature and high humidity was large and, in addition, the fixing characteristic was also deteriorated failing to obtain a satisfactory result.

Further, in Comparative Example 5, since the polyethylene wax was used as the wax, the rising characteristic of the charged amount and the fixing characteristic were deteriorated extremely failing to obtain satisfactory result.

As a collective evaluation for the results of comparison between Examples 1 to 19 according to the invention and Comparative Examples 1 to 5, both of the charging property and the fixing property can be satisfied in a basic constitution comprising the polyester resin having the aromatic alcohol ingredient as the binder resin as described above, the organic bentonite as the charge controller, and the non-polar paraffin wax as the wax.

Further, in view of the results shown in Table 2, also for improving the rising characteristic of the charged amount, it has been demonstrated based on the results of the examples that the acid value for the polyester resin of the invention within the range from 4 mgKOH/g to 31 mgKOH/g is a practicable range, and the range from 5 mgKOH/g to 30 mgKOH/g is a preferred range as described above. Further, in view of the examples, it can be said that the range from 5 mgKOH/g to 28 mgKOH/g is suitable as a more preferred range.

Further, it has been demonstrated based on the results of the examples that the chargeability can be improved more by using the organic bentonite as the charge controller of the invention and, for the addition amount thereof, the range from 0.4% by weight to 6% by weight is a practicable range based on the results of Table 2 and the range from 0.5% by weight to 5% by weight is a preferred range as described above. Further, according to the examples, it can be said that the range from 0.6% by weight to 4% by weight is suitable as a more preferred range.

Further, in a case of using the organic bentonite as the charge controller in the invention, it has been demonstrated for the particle size (volume average particle size $D_{50}$) as other factor based on the results of the examples that the range up to 9 μm is a practicable range where the charging property is stabilized sufficiently and, 8 μm or less is favorable as described above. According to the examples, it can be said that 7 μm or less is more suitable for the particle size. This somewhat undergoes the effect also for the range of the acid value of the binder resin as other constituent factor.

Further, the fixing characteristic and the charging characteristic can be improved by using the non-polar paraffin wax as the wax in the invention and it has been demonstrated for the addition amount that the range from 0.7% by weight to 11% by weight was a practicable range based on the results of Table 2 and the range from 1% by weight to 10% by weight was a preferred range as has been described above. As a more preferred range of the addition amount, it can be said that the range from 2% by weight to 8% by weight is suitable from the results of the examples as a more preferred range.

Further, the DSC peak temperature for improving the fixing characteristic and the storability as other factor of using the non-polar paraffin wax as the wax of the invention, it has been demonstrated that the range from 68° C. to 103° C. was a practicable range based on the results of Table 2 and the range from 70° C. to 100° C. was preferred as described previously. Then, as a more preferred range, it can be said that a range from 71° C. to 98° C. is suitable based on the results of the examples.

(As for the Electrophotographic Toner According to a Second Embodiment of the Invention)

(3) Preparation Example of Charge Controller

In the same manner as in Example 1, 10 g of bentonite at a pH value from 7 to 12 was dispersed in 300 ml of deionized water by stirring at 80° C. for one hour to prepare a liquid bentonite suspension. Then, after controlling 5.3 g of an aqueous solution of distearyldimethylammonium chloride (DSDMAC) at 77% concentration to a pH value of about 9 by using a diluted NaOH solution, it was added to the liquid bentonite suspension, stirred at 80° C. for one hour, separated by filtration, washed several times with deionized water, then dried at 60° C. in vacuum, and applied with a treatment for decreasing the particle size, to obtain charge controllers (organic bentonite) of different volume average particle size $D_{50}$. The volume average particle size $D_{50}$ of the prepared charge controllers are as described in each of examples and comparative examples in the following Table 3.

Example 20

| | |
|---|---|
| Polyester resin (acid value: 21 mg/KOH/g) aromatic alcohol ingredient: PO-BPA and EP-BPA acid ingredient: fumaric acid and mellitic acid anhydride | 87.5 wt % |
| C.I. Pigment Blue 15:1 | 5 wt % |
| Non-polar paraffin wax (DSP peak 78° C., Mw $8.32 \times 10^2$) | 6 wt % |
| Charge controller (prepared by the preparation example described above: volume average particle size 2 μm) | 1.5 wt % |

Mw for the non-polar paraffin wax represents a weight average molecular weight as is well-known.

After pre-mixing each of the constituent materials described above by a Henschel mixer, they were melt kneaded by a twin screw extrusion kneader. After coarsely pulverizing the kneading product by a cutting mill, it was finely pulverized by a jet mill and then classified by a pneumatic classifier to prepare a toner matrix particle with an average particle size of 6.5 μm. Then, 1.2% by weight of metatitanic acid subjected to a hydrophobic treatment with i-butyltrimethoxy silane with a volume average particle size of 40 nm and 1.0% by weight of fine silica particles subjected to a hydrophobic treatment with HMDS with a volume average particle size of 12 nm were added to 97.8% by weight of the classified toner matrix particle, mixed in a Henschel mixer, and applied with external addition to prepare a toner for cyan evaluation.

Example 21

A toner was prepared in the same manner as in Example 20 except for changing the acid value of the polyester resin to 5 mgKOH/g as shown in the following Table 3.

Example 22

A toner was prepared in the same manner as in Example 20 except for changing the acid value of the polyester resin to 28 mgKOH/g as shown in the following Table 3.

Example 23

A toner was prepared in the same manner as in Example 20 except for changing the acid value of the polyester resin to 4 mgKOH/g as shown in the following Table 3.

Example 24

A toner was prepared in the same manner as in Example 20 except for changing the acid value of the polyester resin to 31 mgKOH/g as shown in the following Table 3.

Example 25

A toner was prepared in the same manner as in Example 20 except for changing the volume average particle size of the organic bentonite as the charge controller to 7 μm as shown in Table 3.

Example 26

A toner was prepared in the same manner as in Example 20 except for changing the volume average particle size of the organic bentonite as the charge controller to 9 μm as shown in Table 3.

Example 27

A toner was prepared in the same manner as in Example 20 except for changing the number of parts by weight of the organic bentonite as the charge controller to 0.4% by weight as shown in Table 3.

Example 28

A toner was prepared in the same manner as in Example 20 except for changing the number of parts by weight of the organic bentonite as the charge controller to 0.6% by weight as shown in Table 3.

Example 29

A toner was prepared in the same manner as in Example 20 except for changing the number of parts by weight of the organic bentonite as the charge controller to 4% by weight as shown in Table 3.

Example 30

A toner was prepared in the same manner as in Example 20 except for changing the number of parts by weight of the organic bentonite as the charge controller to 6% by weight as shown in Table 3.

Example 31

A toner was prepared in the same manner as in Example 20 except for changing the volume average particle size of metatitanic acid as the external ingredient to 30 nm.

Example 32

A toner was prepared in the same manner as in Example 20 except for changing the volume average particle size of metatitanic acid as the external ingredient to 25 nm.

Example 33

A toner was prepared in the same manner as in Example 20 except for changing the volume average particle size of metatitanic acid as the external ingredient to 50 nm.

Example 34

A toner was prepared in the same manner as in Example 20 except for changing the volume average particle size of metatitanic acid as the external ingredient to 25 nm.

Example 35

A toner was prepared in the same manner as in Example 20 except for changing the addition wt % of metatitanic acid as the external ingredient to 0.3% by weight.

Example 36

A toner was prepared in the same manner as in Example 20 except for changing the addition wt % of metatitanic acid as the external ingredient to 0.2% by weight.

Example 37

A toner was prepared in the same manner as in Example 20 except for changing the addition wt % of metatitanic acid as the external ingredient to 2.0% by weight.

Example 38

A toner was prepared in the same manner as in Example 20 except for changing the addition wt % of metatitanic acid as the external ingredient to 2.2% by weight.

Example 39

A toner was prepared in the same manner as in Example 20 except for changing the external additive to a chlorosilane type methyl trichlorosilane as shown in Table 3.

The toner of the invention by each of the examples prepared as described above and comparative examples for comparison are to be described below.

Comparative Example 6

A toner was prepared in the same manner as in Example 20 except for changing the polyester resin to a polyester resin comprising an aliphatic alcohol ingredient as shown in Table 3, that is, alcohol ingredient: ethylene glycol, diethylene glycol, and neopentyl glycol, acid ingredient: naphthalene dicarboxylic acid and terephthalic acid.

Comparative Example 7

A toner was prepared in the same manner as in Example 20 except for changing the charge controller to a zirconium compound of salicylic acid as shown in Table 3.

Comparative Example 8

A toner was prepared in the same manner as in Example 20 except for changing the charge controller to a zinc compound of salicylic acid as shown in Table 3.

Comparative Example 9

A toner was prepared in the same manner as in Example 20 except for changing the external additive to titanium oxide with a volume average particle size of 40 nm subjected to a hydrophobic treatment with i-butyltrimethoxy silane.

Toners of Examples 20 to 39 and Comparative Examples 6 to 9 prepared as described above, and a silicon coated ferrite core carrier with an average particle size of 60 μm were formulated to a toner concentration of 5% by weight to prepare two-component developers.

In the following Table 3, the particle size represents the volume average particle size $D_{50}$, and the number of parts represents % by weight. Further, the organic bentonite has a salt structure comprising an alkaline bentonite and an organic cation, which was obtained in the above-mentioned preparation examples.

TABLE 3

| | Polyester resin | | | Charge controller | | metatitanic acid(external additive) | | |
|---|---|---|---|---|---|---|---|---|
| | Alcohol ingredient | Acid value | Compositions | Particle size $D_{50}$ (μm) | Number of parts (wt %) | treating agent | particle size (nm) | Number of external additive (wt %) |
| Example 20 | Aromatic | 21 | Organic bentonite | 2 | 1.5 | i-butyltrimethoxy silane | 40 | 1.2 |
| Example 21 | Aromatic | 5 | Organic bentonite | 2 | 1.5 | i-butyltrimethoxy silane | 40 | 1.2 |
| Example 22 | Aromatic | 28 | Organic bentonite | 2 | 1.5 | i-butyltrimethoxy silane | 40 | 1.2 |
| Example 23 | Aromatic | 4 | Organic bentonite | 2 | 1.5 | i-butyltrimethoxy silane | 40 | 1.2 |
| Example 24 | Aromatic | 31 | Organic bentonite | 2 | 1.5 | i-butyltrimethoxy silane | 40 | 1.2 |
| Example 25 | Aromatic | 21 | Organic bentonite | 7 | 1.5 | i-butyltrimethoxy silane | 40 | 1.2 |
| Example 26 | Aromatic | 21 | Organic bentonite | 9 | 1.5 | i-butyltrimethoxy silane | 40 | 1.2 |
| Example 27 | Aromatic | 21 | Organic bentonite | 2 | 0.4 | i-butyltrimethoxy silane | 40 | 1.2 |
| Example 28 | Aromatic | 21 | Organic bentonite | 2 | 0.6 | i-butyltrimethoxy silane | 40 | 1.2 |
| Example 29 | Aromatic | 21 | Organic bentonite | 2 | 4 | i-butyltrimethoxy silane | 40 | 1.2 |
| Example 30 | Aromatic | 21 | Organic bentonite | 2 | 6 | i-butyltrimethoxy silane | 40 | 1.2 |

TABLE 3-continued

| | Polyester resin | | | Charge controller | | metatitanic acid(external additive) | | |
|---|---|---|---|---|---|---|---|---|
| | Alcohol ingredient | Acid value | Compositions | Particle size $D_{50}$ (μm) | Number of parts (wt %) | treating agent | particle size (nm) | Number of external additive (wt %) |
| Example 31 | Aromatic | 21 | Organic bentonite | 2 | 1.5 | i-butyltrimethoxy silane | 30 | 1.2 |
| Example 32 | Aromatic | 21 | Organic bentonite | 2 | 1.5 | i-butyltrimethoxy silane | 25 | 1.2 |
| Example 33 | Aromatic | 21 | Organic bentonite | 2 | 1.5 | i-butyltrimethoxy silane | 50 | 1.2 |
| Example 34 | Aromatic | 21 | Organic bentonite | 2 | 1.5 | i-butyltrimethoxy silane | 55 | 1.2 |
| Example 35 | Aromatic | 21 | Organic bentonite | 2 | 1.5 | i-butyltrimethoxy silane | 40 | 0.3 |
| Example 36 | Aromatic | 21 | Organic bentonite | 2 | 1.5 | i-butyltrimethoxy silane | 40 | 0.2 |
| Example 37 | Aromatic | 21 | Organic bentonite | 2 | 1.5 | i-butyltrimethoxy silane | 40 | 2 |
| Example 38 | Aromatic | 21 | Organic bentonite | 2 | 1.5 | i-butyltrimethoxy silane | 40 | 2.2 |
| Example 39 | Aromatic | 21 | Organic bentonite | 2 | 1.5 | i-butyltrimethoxy silane | 40 | 1.2 |
| Comp. Example 6 | Aliphatic | 18 | Organic bentonite | 2 | 1.5 | i-butyltrimethoxy silane | 40 | 1.2 |
| Comp. Example 7 | Aromatic | 21 | Zirconium compound of salicylate | — | 1.5 | i-butyltrimethoxy silane | 40 | 1.2 |
| Comp. Example 8 | Aromatic | 21 | Zinc compound of salicylate | — | 1.5 | i-butyltrimethoxy silane | 40 | 1.2 |
| Comp. Example 9 | Aromatic | 21 | organic bentonite | 2 | 1.5 | titanium oxide | 40 | 1.2 |

(The external additive of comparative example 9 is one which was obtained by treating the conventional titanium oxide with i-butyltrimethoxy silane.)

(4) Evaluation Method for Examples and Comparative Examples is to be Described.

i. Initial Charged Amount

After setting a developer to a commercial copying machine having a two component developing device (AR-C160, manufactured by Sharp Corp.) and rotating idly for 3 min under normal temperature and normal humidity, the developer was sampled and the charged amount was measured by a suction type charged amount measuring apparatus (210H-2A Q/M Meter, manufactured by TREK Co.). It was judged as utilizable in a case where the charged amount was −20 μC/g or more and good in a case where the charged amount was −25 μC/g or more.

ii. Rising Characteristic of Charging

After stirring a 5 ml glass bottle containing 0.95 g of a carrier (silicon coated ferrite core carrier) and 0.05 g of a toner for one min by a rotary culturing machine at 32 rpm, the developer was sampled and the charged amount was measured by the suction type charged amount measuring apparatus. Further, after stirring for 3 min, the charged amount was measured in the same manner. It was judged as utilizable in a case where the absolute value for the difference of charged amount after one min and after 3 min was 7 μC/g or less and as good in a case where the value was 5 μC/g or less.

iii. Decaying Characteristic of Charging

After stirring a 100 ml polyethylene vessel containing 76 g of a carrier (silicon coated ferrite core carrier) and 4 g of a toner by a ball mill at 150 rpm for 60 min, the charged amount of the developer was measured and it was exposed to high temperature and high humidity. The charged amounts of the developer after one day, after 3 day, and after 10 day were measured and it was judged as utilizable in a case where the absolute value for the difference relative to the charged amount at the first day was 7 μC/g or less and as good in a case where the value was 5 μC/g or less.

iv. Life Characteristic of Charging

After setting a developer to a commercial copying machine having a two component developing device (AR-C160, manufactured by Sharp Corp.) and actually copying 50,000 sheets of solid images at normal temperature and normal humidity, the image density for the image area, the whiteness for the non-image area, and the charged amount of the developer were measured. The image density was measured by an X-Rite 938 spectral calorimetric densitometer and it was judged as good in a case where the image density was 1.4 or more. For the whiteness, tristimulus values X, Y, and Z were determined by using a model SZ90 spectral color difference meter manufactured by Nippon Denshoku Industry Co. and it was judged as utilizable in a case where the ΔX value was 0.7 or less and as good in a case where it was 0.5 or less. The charged amount of the developer was judged by a suction type charged amount measuring apparatus and it was judged as utilizable in a case where the absolute value for the difference relative to the initial charged amount was 7 μC/g or less and as good in a case where it was 5 μC/C or less.

v. Fixing Characteristic

A fixing device (oil less system) of a commercial full color copying machine (ARC-260, manufactured by Sharp Corp.) was modified, an external fixing machine capable of freely setting a roller temperature was used, the paper feed rate was set to 120 mm/sec, and the temperature was changed from 100° C. to 230° C. each by 5° C. In this case, an offset phenomenon where images were re-transferred to the non-image area was observed and the temperature at which the images were not re-transferred was defined as a non-offset temperature.

For the non-offset area, it was judged as utilizable where the range was 40° C. or higher and as good where the range was 50° C. or higher.

The result for evaluation from i to v are shown in Table 4. The overall evaluation was conducted by three ranks of "A", "B", and "C".

sufficiently melted, the boundary between the toner particles was eliminated, the transparency was also good and satisfactory, fixing could be conducted. As described above, good results were obtained in all of the items.

Further, Examples 21, 22, 25, 28, 29, 31, 33, 35, and 37 provided good results in all of the items in the same manner as in Example 20.

In Example 23, since the acid value of the resin was as low as 4 mgKOH/g, while the charging characteristic was somewhat lowered compared with Example 20, the initial charging characteristic, rising characteristic of charging were each in a utilizable region suitable enough to actual use.

TABLE 4

| | Charged amount (−μC/g) | | | | | | | | | | | |
|---|---|---|---|---|---|---|---|---|---|---|---|---|
| | | Rising characteristic | | Decaying characteristic | | | | | | | | |
| | Initial stage | After 1 min | After 3 min | Fist day | after 1 day | after 3 day | after 10 day | Life characteristic 50,000 sheet | Image density | Whiteness | Fixing characteristic | Overall evaluation |
| Example 20 | 28 | 30 | 32 | 28 | 27 | 26 | 26 | 25 | 1.53 | 0.2 | 145-210 | A |
| Example 21 | 25 | 27 | 30 | 26 | 25 | 24 | 24 | 23 | 1.57 | 0.3 | 145-210 | A |
| Example 22 | 31 | 33 | 35 | 30 | 28 | 27 | 27 | 28 | 1.48 | 0.2 | 145-210 | A |
| Example 23 | 21 | 22 | 25 | 20 | 19 | 18 | 18 | 20 | 1.68 | 0.5 | 145-210 | B |
| Example 24 | 35 | 36 | 40 | 32 | 26 | 25 | 25 | 30 | 1.43 | 0.5 | 145-210 | B |
| Example 25 | 31 | 32 | 35 | 28 | 26 | 25 | 25 | 29 | 1.58 | 0.4 | 145-210 | A |
| Example 26 | 25 | 28 | 32 | 25 | 23 | 22 | 22 | 22 | 1.62 | 0.6 | 145-210 | B |
| Example 27 | 23 | 23 | 26 | 22 | 20 | 20 | 20 | 20 | 1.68 | 0.5 | 145-210 | B |
| Example 28 | 25 | 26 | 29 | 24 | 22 | 22 | 22 | 22 | 1.60 | 0.5 | 145-210 | A |
| Example 29 | 29 | 30 | 32 | 30 | 27 | 27 | 27 | 28 | 1.46 | 0.2 | 150-200 | A |
| Example 30 | 31 | 33 | 35 | 29 | 27 | 26 | 26 | 29 | 1.50 | 0.3 | 150-190 | B |
| Example 31 | 29 | 30 | 34 | 30 | 28 | 27 | 27 | 27 | 1.42 | 0.3 | 145-210 | A |
| Example 32 | 28 | 30 | 34 | 27 | 27 | 27 | 27 | 25 | 1.38 | 0.3 | 145-210 | B |
| Example 33 | 29 | 30 | 34 | 29 | 26 | 26 | 26 | 28 | 1.49 | 0.5 | 145-210 | A |
| Example 34 | 23 | 24 | 30 | 21 | 20 | 18 | 18 | 19 | 1.68 | 0.6 | 145-210 | B |
| Example 35 | 30 | 31 | 32 | 29 | 27 | 27 | 27 | 26 | 1.61 | 0.5 | 140-210 | A |
| Example 36 | 25 | 26 | 32 | 24 | 21 | 20 | 20 | 20 | 1.69 | 0.7 | 140-210 | B |
| Example 37 | 22 | 25 | 29 | 24 | 21 | 20 | 20 | 21 | 1.69 | 0.3 | 145-210 | A |
| Example 38 | 22 | 23 | 29 | 20 | 17 | 16 | 16 | 17 | 1.69 | 0.7 | 145-210 | B |
| Example 39 | 29 | 28 | 35 | 32 | 28 | 28 | 28 | 28 | 1.49 | 0.7 | 145-210 | B |
| Comp. Example 6 | 23 | 22 | 29 | 21 | 12 | 11 | 11 | 16 | 1.70 | 0.8 | 145-210 | C |
| Comp. Example 7 | 19 | 21 | 24 | 19 | 15 | 14 | 14 | 14 | 1.73 | 0.8 | 145-210 | C |
| Comp. Example 8 | 18 | 20 | 24 | 19 | 15 | 14 | 14 | 14 | 1.72 | 0.9 | 145-210 | C |
| Comp. Example 9 | 24 | 25 | 35 | 24 | 21 | 20 | 20 | 14 | 1.73 | 0.9 | 145-210 | C |

From the results shown in Table 4 above, the cyan toners manufactured by each of Examples 20 to 39 according to the invention were excellent in both of the charging characteristic and the fixing characteristic and could keep stable development as described below compared with the cyan toners shown in Comparative Examples 6 to 9.

For example, the electrophotographic toner according to Example 20 of the invention showed the initial charged amount of −30 μC/g showing a value of −25 μC/g or more as shown in Table 4. Further, the rising characteristic of the charging was −30 μC/g after stirring for one min and −32 μC/g after stirring for 3 min, in which the difference of the absolute amount of the charged amount was 5 μC/g or less. Further, the decaying characteristic was −28 μC/g at the first day and −26 μC/g after ten days, in which the difference of the absolute amount of the charged amount was 5 μC/g or less. The charged amount after actual copying of 50,000 sheets was −25 μC/g, and the difference relative to the initial charged amount was 5 μC/g or less. The image density was 1.53, i.e., 1.4 or more and the whiteness was 0.2, i.e., 0.5 or less. As described above, it can be said that the toner was excellent in the charging characteristic.

Further, the range where the low temperature offset and the high temperature offset did not occur in a case of melting and fixing the toner (fixing characteristic) was from 145 to 210° C., i.e., 50° C. or higher. In view of the above, the toner was In Example 24, since the acid value of the resin was as high as 31 mgKOH/g, while the decay of the charged amount increased under high temperature and high humidity compared with Example 20, it was in a utilizable region suitable enough to actual use.

Further, in Example 26, since the volume average particle size of the organic bentonite was increased as 9 μm, while the charging characteristic was worsened compared with Example 20, the rising characteristic of charging was sufficient and it can be said that also the whiteness was in a utilizable region.

In Example 27, since the addition amount of the organic bentonite was decreased as 0.4% by weight, while the charging characteristic was somewhat lowered compared with Example 20, the initial charged amount, the rising characteristic of charging and the whiteness were each in a sufficiently utilizable region in view of the judgement for the performance.

In Example 30, since the addition amount of the organic bentonite was increased as 6% by weight, while the fixing property was somewhat lowered compared with Example 20, there was no trouble for other charging characteristics and they were in sufficiently utilizable regions.

In Example 32, since the volume average particle size of metatitanic acid was decreased as 25 nm, while the transfer efficiency was lowered to 1.38, it was in a sufficiently utilizable region in view of the judgement for the performance.

In Example 34, since the volume average particle size of metatitanic acid was increased as 55 nm, while the charging characteristic was lowered and the whiteness was 0.6, it was in a sufficiently utilizable region in view of the judgement for the performance.

In Example 36, since the addition amount of metatitanic acid was decreased as 0.2% by weight, while the charging characteristic was lowered, the rising characteristic of charged amount was lowered, and the whiteness was deteriorated as 0.7, they were each in a sufficiently utilizable region in view of the judgement for the performance.

In Example 38, since the addition amount of metatitanic acid was increased as 2.2% by weight, while the charging characteristic was lowered, the rising characteristic of charged amount was lowered, and the whiteness was worsened as 0.7 under the effect of free materials, they were each in a sufficiently utilizable region in view of the judgement for the performance.

In Example 39, since chlorosilane type methyltrichloro silane was used for the surface treatment of metatitanic acid, while the charging characteristic was lowered and the rising characteristic of charged amount was lowered, and the whiteness was worsened as 0.7, they were each in a sufficiently utilizable region in view of the judgement for the performance.

As described above, by the use of the polyester resin having the aromatic alcohol ingredient, the circumstantial humidity characteristic is excellent and the charge decaying ratio at high temperature and at high humidity was decreased. Further, since the organic bentonite and the non-polar paraffin wax were incorporated in the resin, the initial charged amount and the rising of charged amount of the toner showed appropriate characteristics by the organic bentonite finely dispersed in the toner and the life stability was also improved. Further, in the constitution, metatitanic acid subjected to the hydrophobic treatment can improve the charging characteristics of the toner.

On the contrary, in Comparative Example 6, since the polyester resin having the aliphatic alcohol ingredient was used, decay of the charged amount under high temperature and high humidity was large and, further, images with background fogging of high whiteness were formed and no satisfactory results could be obtained compared with the toners of Examples 20 to 39 of the invention.

In Comparative Examples 7 and 8, since charge controllers other than organic bentonite were used, the initial charged amount was lowered to form images with background fogging of high whiteness and, in addition, the fixing characteristic was also worsened failing to obtain satisfactory results.

Further, in Comparative Example 9, since usual titanium oxide was used for the external additive instead of metatitanic acid, the initial charged amount was lowered and images with background fogging of high whiteness were formed failing to obtain satisfactory result.

As a collective evaluation for the results of comparison between Examples 20 to 39 according to the invention and Comparative Examples 6 to 9, both of the charging property and the fixing property can be satisfied in a basic constitution comprising the polyester resin formed by reacting the aromatic alcohol ingredient as the binder resin as described above, the organic bentonite as the charge controller, and the metatitanic acid subjected to a hydrophobic treatment as the external additive.

Further, in view of the results shown in Table 4, also for improving the rising characteristic of the charged amount, it has been demonstrated based on the results of the examples that the acid value for the polyester resin of the invention within the range from 4 mgKOH/g to 31 mgKOH/g is a practicable range, and the range from 5 mgKOH/g to 30 mgKOH/g is a preferred range as described above. Further, in view of the examples, it can be said that the range from 5 mgKOH/g to 28 mgKOH/g is suitable as a more preferred range.

Further, it has been demonstrated based on the results of the examples that the chargeability can be improved more by using the organic bentonite as the charge controller of the invention and, for the addition amount thereof, the range from 0.4% by weight to 6% by weight is a practicable range based on the results of Table 4 and the range from 0.5% by weight to 5% by weight is a preferred range as described above. Further, according to the examples, it can be said that the range from 0.6% by weight to 4% by weight is suitable as a more preferred range.

Further, in a case of using the organic bentonite as the charge controller in the invention, it has been demonstrated for the particle size (volume average particle size $D_{50}$) as other factor based on the results of the examples that the range up to 9 μm is a practicable range where the charging property is stabilized sufficiently and, 8 μm or less is favorable as described above. According to the examples, it can be said that 7 μm or less is more suitable for the particle size. This somewhat undergoes the effect also for the range of the acid value of the binder resin as other constituent factor.

Further, the charging characteristic can be improved by using metatitanic acid subjected to the hydrophobic treatment as the external additive in the invention. For the addition amount for this purpose, a range from 0.2% by weight to 2.2% by weight is a practicable range based on the results in Table 4 and this demonstrates that the range from 0.3% by weight to 2.0% by weight is a preferred range as described previously.

Further, in view of the results of Comparative Example 9, even in a case of incorporating the organic bentonite to the toner matrix particles, the charging characteristic can not be maintained satisfactorily by use of titanium oxide instead of metatitanic acid subjected to the hydrophobic treatment as the external additive to be used. In this regard, according to the invention, since metatitanic acid subjected to the hydrophobic treatment is used as the external additive, the improved state of the charging characteristic by the incorporation of the organic bentonite can be maintained. Accordingly, it can be said that use of metatitanic acid subjected to the hydrophobic treatment as the external additive to the toner matrix particle incorporated with the organic bentonite is extremely useful as described above.

As has been described above, the cyan toner is illustrated as the electrophotographic toner in the examples. While C. I. Pigment Blue 15:3 for cyan is incorporated as the colorant, it can be practiced in the same manner also by incorporating various colorants exemplified previously instead of the cyan colorant.

For this purpose, in a case of preparing toners of yellow, magenta, and cyan described in the examples and, further, black and forming color images, high fidelity color reproduction is possible by melting superposed toners of respective colors thereby eliminating the boundary between each of the toner particles to obtain sufficient transparency. Further, also in view of the charging characteristic, since stable development is possible by obtaining high humidity resistance and sufficiently stable charged amount based on the results shown in Table 2, the color reproducibility described above can be expected.

Further, in a case of forming not only color images but also monochromatic images, i.e., black and white images by a black toner, stable high fidelity images can be always reproduced not depending on the circumstantial change with a toner excellent in the charging characteristic and the fixing characteristic berated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic toner comprising at least:

a binder resin;

a colorant;

a charge controller; and a wax, wherein the binder resin is a polyester resin having an aromatic alcohol ingredient, the charge controller is an organic bentonite and the wax consists of a non-polar paraffin wax as a wax, wherein a volume average particle size $D_{50}$ of the organic bentonite is within the range of 2 to 9 μm, and wherein the organic bentonite has a salt structure comprising an alkaline bentonite and an organic cation.

2. The electrophotographic toner of claim 1, wherein a differential scanning calorimeter absorption peak temperature of the wax is in a range of from 68° C. to 103° C.

3. The electrophotographic toner of claim 1, wherein an addition amount of the charging controller is in a range of from 0.4% by weight to 6% by weight based on an entire amount of the toner.

4. The electrophotographic toner of claim 1, wherein an addition amount of the wax is in a range of from 0.7% by weight to 11% by weight based on the entire amount of the toner.

5. The electrophotographic toner of claim 1, wherein an acid value of the binder resin is in a range of from 4 mgKOH/g to 31 mgKOH/g.

6. An electrophotographic toner comprising:

a toner matrix particles containing at least a binder resin, a wax consisting of a non-polar paraffin wax, a colorant and a charge controller; and an external additive, wherein the binder resin contains a polyester resin formed by reacting an aromatic alcohol ingredient, the charge controller contains an organic bentonite, and the external additive contains metatitanic acid subjected to a hydrophobic treatment, wherein a volume average particle size $D_{50}$ of the organic bentonite is within the range of 2 to 9 μm, and wherein the organic bentonite has a salt structure comprising an alkaline bentonite and an organic cation.

7. The electrophotographic toner of claim 6, wherein a hydrophobic treating agent of the hydrophobic treatment for the metatitanic acid is an alkoxy silane.

8. The electrophotographic toner of claim 6, wherein an addition amount of the organic bentonite is in a range of from 0.4% by weight to 6% by weight based on the entire amount of the toner.

9. The electrophotographic toner of claim 6, wherein a volume average particle size of the metatitanic acid subjected to a hydrophobic treatment is in a range of from 30 μm to 50 μm.

10. The electrophotographic toner of claim 6, wherein the acid value of the polyester resin formed by reacting the aromatic alcohol ingredient is in a range of from 4 mgKOH/g to 31 mgKOH/g.

11. The electrophotographic toner of claim 6, wherein an addition amount of the metatitanic acid subjected to a hydrophobic treatment is in a range of from 0.3% by weight to 2% by weight based on the entire amount of the toner.

12. The electrophotographic toner of claim 6, wherein the external additives of the electrophotographic-toner further comprises a silica subjected to a hydrophobic treatment.

* * * * *